US006868822B1

(12) United States Patent
Di Pietro

(10) Patent No.: US 6,868,822 B1
(45) Date of Patent: Mar. 22, 2005

(54) ROTARY PISTON ENGINE

(75) Inventor: Angelo Di Pietro, Hoppers Crossing (AU)

(73) Assignee: Engineair Pty Ltd, Victoria (AU)

( * ) Notice: Subject to any disclaimer, the term of this patent is extended or adjusted under 35 U.S.C. 154(b) by 0 days.

(21) Appl. No.: 10/031,954

(22) PCT Filed: Jul. 14, 2000

(86) PCT No.: PCT/AU00/00849

§ 371 (c)(1),
(2), (4) Date: Jun. 14, 2002

(87) PCT Pub. No.: WO01/06093

PCT Pub. Date: Jan. 25, 2001

(30) Foreign Application Priority Data

Jul. 15, 1999 (AU) ..... PQ1647

(51) Int. Cl.[7] ..... F02B 53/04; F02B 53/06

(52) U.S. Cl. ..... 123/232; 123/238; 123/246; 418/196; 418/227

(58) Field of Search ..... 123/232, 231, 123/249, 239, 238, 246; 418/227, 61.3, 61.2, 196

(56) References Cited

U.S. PATENT DOCUMENTS

| | | | | | |
|---|---|---|---|---|---|
| 2,198,130 A | * | 4/1940 | Schweiger | ..... | 123/232 |
| 2,418,793 A | * | 4/1947 | Selden | ..... | 123/238 |
| 2,742,882 A | * | 4/1956 | Porter | ..... | 123/246 |
| 2,920,814 A | * | 1/1960 | Breelle | ..... | 123/232 |
| 3,322,103 A | * | 5/1967 | Dirnberger | ..... | 418/227 |
| 3,584,984 A | * | 6/1971 | Majkowski et al. | ..... | 418/196 |
| 3,799,126 A | * | 3/1974 | Park | ..... | 123/246 |
| 3,935,840 A | * | 2/1976 | Fisher | ..... | 123/238 |
| 4,057,035 A | * | 11/1977 | Su | ..... | 123/232 |

FOREIGN PATENT DOCUMENTS

| | | | | |
|---|---|---|---|---|
| CA | 988035 | * | 4/1976 | ..... F01C/1/40 |
| DE | 3321631 A | * | 12/1984 | ..... F02B/53/06 |
| GB | 2077857 A | * | 12/1981 | ..... F01C/1/12 |

* cited by examiner

*Primary Examiner*—Thomas Denion
*Assistant Examiner*—Thai Ba Trieu
(74) *Attorney, Agent, or Firm*—John A. Artz; Artz & Artz, P.C.

(57) ABSTRACT

A non-reciprocating engine comprising a hollow cylindrical shaft driver (13) located in a cylindrical stator cavity (14) of a stator. A number of expansion chambers (43) form between the outer wall of the shaft driver, the stator wall and movable dividers (25) which extend from the stator to bear on the shaft driver. The expansion chambers expand and contract during operation of the engine. An output shaft passes centrally through the stator cavity and shaft driver and has offset bearings (34) which bear on the inside surface of the shaft driver. Inlet ports in a removable inlet end plate of the stator allow pressurised air or air/fuel mixture, for example, to be introduced into the expansion chambers. Sequential expansion and contraction of the chambers around the circumference of the shaft driver causes a combination of orbital and rotational movement of the shaft driver and consequential rotation of the output shaft. The shaft driver rotates at only a fraction of the speed of rotation of the output shaft (in the order of $1/10^{th}$–$1/20^{th}$ the speed of rotation of the output shaft). One orbit of the shaft driver is equivalent to one rotation of the output shaft.

11 Claims, 6 Drawing Sheets

ROTARY PISTON ENGINE

The present invention relates to motors or engines and more particularly to a crankless engine which may be in the form of an internal combustion engine, a fluid driven motor such as an air motor, or a steam driven engine.

The term "crankless" refers to the fact that the motor does not have a conventional crankshaft and is not subject to reciprocating motion. The output shaft of the engine is in fact a straight shaft which is caused to rotate by offset bearings located in a drive member which may be termed a shaft driver, although in the strict sense, the motion of the so-called shaft driver is more an orbital motion with slow rotation relative to the speed of rotation of the output shaft.

Many different forms of rotary and orbital engines as well as other forms of engines have been proposed in the past with varying degrees of success but overall there has been no serious challenge to the reciprocating internal combustion engine at least insofar as automobiles are concerned. This fact is primarily due to the high wear rate in rotary engines and possibly the fact that the improvements in efficiency of rotary engines over reciprocating engines has not been sufficient to justify a major change in direction for engine manufacturers.

It is an object of this invention to provide an alternative form of a non-reciprocating type motor or engine which overcomes one or more of the shortcomings of prior art engines.

Accordingly the invention provides an engine comprising a hollow cylindrical shaft driver located in a stator cavity of the engine and surrounded by expansion chambers defined between the cylindrical wall of the shaft driver and the wall of the stator cavity, said expansion chambers being separated by movable dividers mounted in said stator and bearing on said shaft driver, an output shaft rotatably supported in said stator and passing centrally through said stator cavity and through said shaft driver, said shaft having bearing means to one side of said shaft which bear on the inside surface of said shaft driver whereby a combination of orbital and rotational movement of said shaft driver causes rotation of said shaft at a rotational speed much greater than the rotational speed of said shaft driver.

In order that the invention may be more readily understood one particular embodiment will now be described with reference to the accompanying drawings which show an air driven engine. In the drawings.

Figure 3:
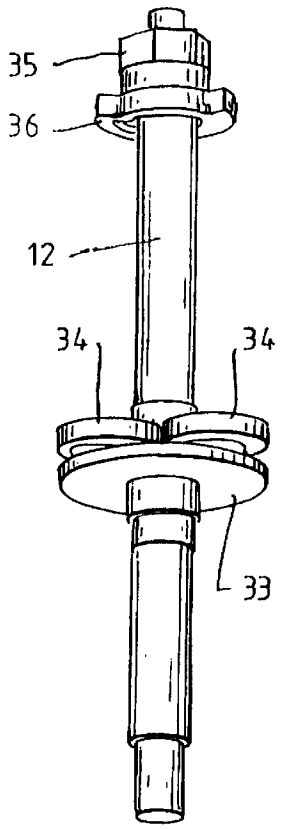
FIG. 3 is a perspective view of an output shaft assembly of the engine.
Figure 2:
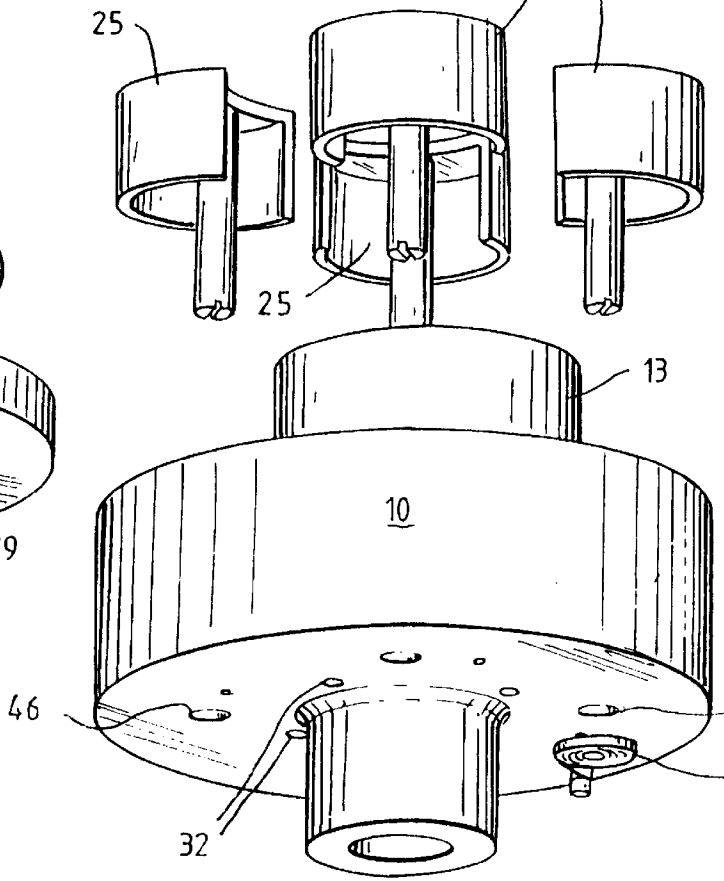
FIG. 2 is a perspective view, from the outside, of a stator of the engine and shows, in exploded view, a shaft driver and movable dividers of the engine.
Figure 1:
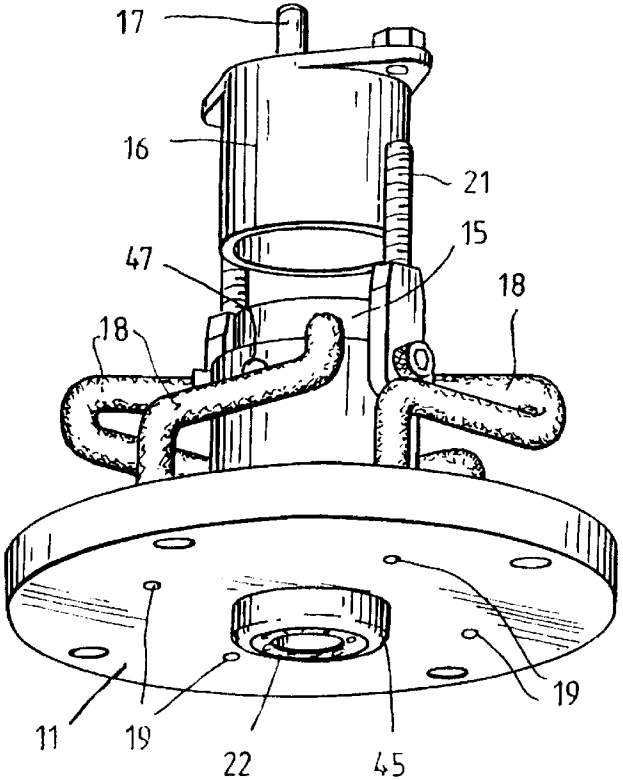
FIG. 1 is a perspective view from the inner side of an inlet end plate and inlet manifold of the engine.
Figure 4:
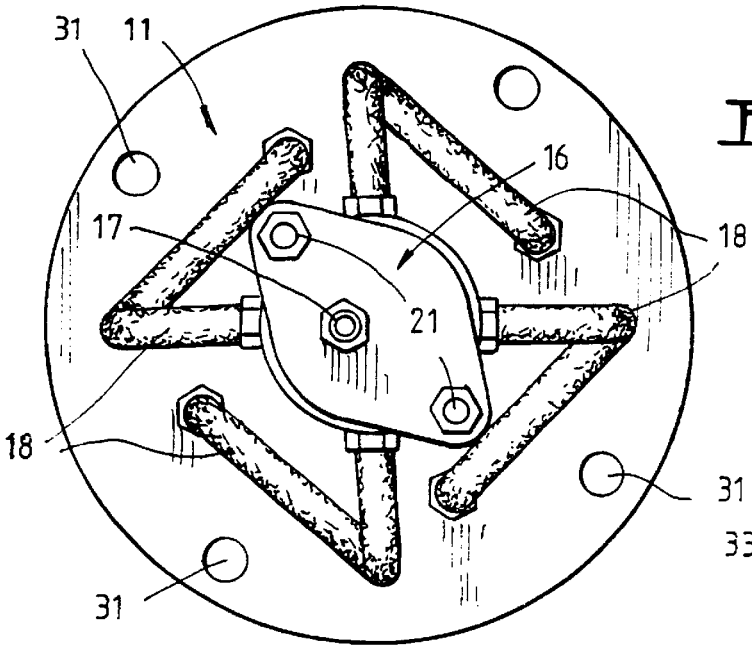
FIG. 4 is an end view of the engine from the inlet manifold end.
Figure 6:
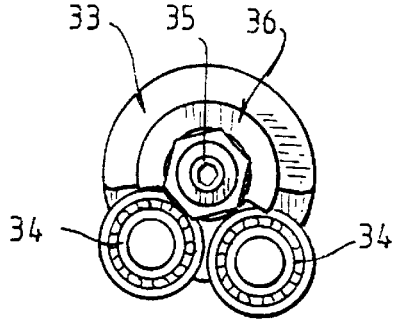
FIG. 6 is an end view of the output shaft assembly.

In the drawings, the engine is shown to comprise essentially a stator 10, an inlet end plate 11 and a output shaft 12. A shaft driver 13 is a hollow cylindrical ring which, when the engine is assembled, is located in a cylindrical stator cavity 14 of the stator 10.

Figure 7:
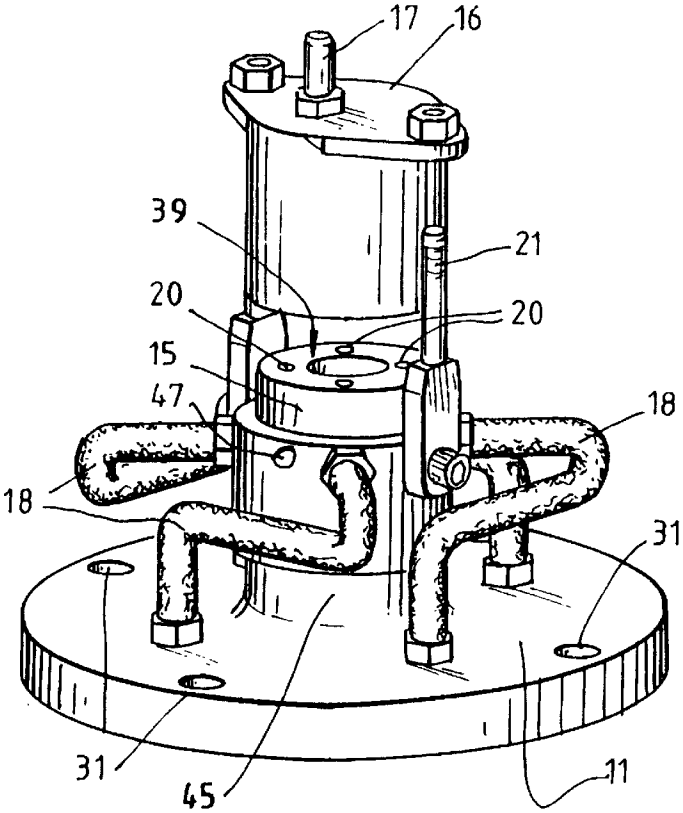
FIG. 7 is a perspective view (partly exploded view) from the outer side of the inlet end plate and inlet manifold.

The inlet end plate 11 has an inlet manifold 15 mounted centrally on the outer end thereof and a removable end cap 16 provides an air intake 17 to the inlet manifold 15. The inlet manifold 15 (see FIG. 7) fits over a cylindrical boss 45 of the end plate 11 and is locked onto the boss 45 by grub screws (not shown). The rotational position of the manifold 15 relative to the boss 45 may be adjusted to vary the timing of the engine. As is evident flexible pressure hoses 18 extend from the inlet manifold to inlet ports 19 in the end plate 11. The interior of the end cap 16 communicates with ports 20 (see FIG. 7), each of which communicates with one of the pressure hoses 18 to distribute inlet air at air intake 17 to the respective inlet ports 19 via the pressure hoses 18. The ports 20 are opened or closed by a timing member 36 locked to the inner end of output shaft 12 as will be described hereinafter. The end cap 16 is fixed to the inlet manifold 15 by bolts 21 which extend axially and enable the end cap 16 to be clamped firmly to the inlet manifold 15 in an airtight arrangement. A roller bearing 22 is located in the end plate 11 to support the output shaft 12.

Figure 5:
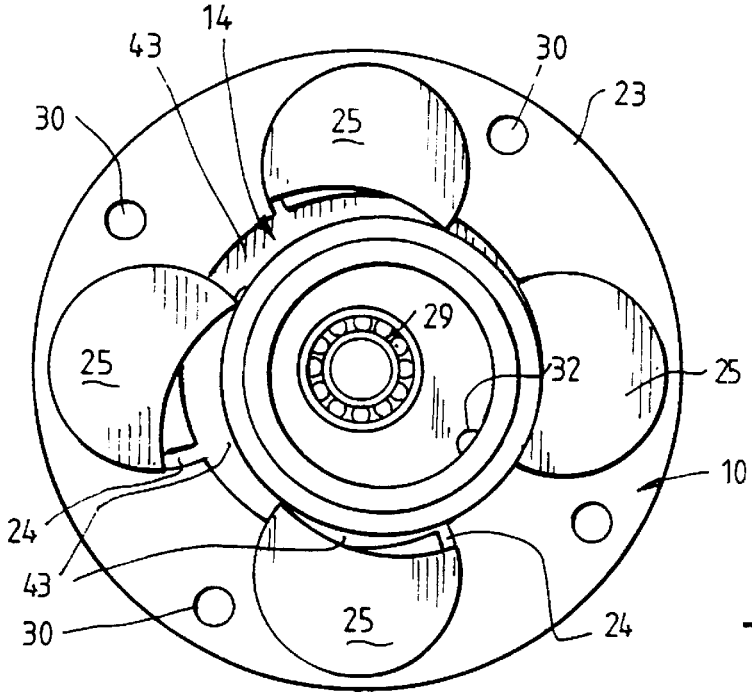
FIG. 5 is a view similar to FIG. 4 with inlet end plate and output shaft removed.
Figure 9:
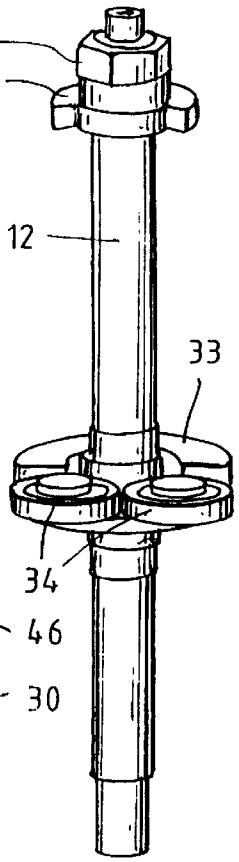
FIG. 9 is a further perspective view (from the opposite end to FIG. 3) of the output shaft assembly.
Figure 8:
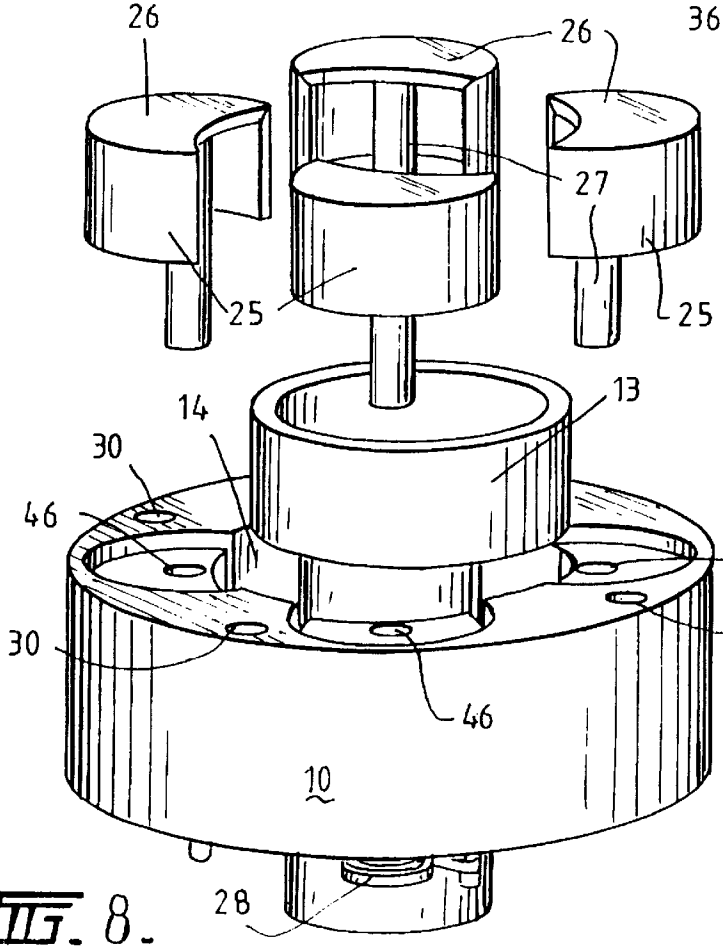
FIG. 8 is a perspective view, from the inside, of the stator, shaft driver, and movable dividers, in an exploded view.

As is more evidence in FIGS. 5 and 8, the stator 10 has a cylindrical stator 14 which is larger in diameter than the diameter of the shaft driver 13. The wall 23 of the stator 10 has part cylindrical grooves 24 which extend arcuately from a point in the stator cavity through the wall 23 and back to the stator cavity at a circumferentially displaced location. These grooves 24 accommodate respective movable dividers 25 which are able to move in the respective grooves 24 whereby an edge of a moveable divider 25 bears on the outer surface of the shaft driver 13. As is evident in FIG. 8 for example, the movable dividers 25 are part cylindrical dividers with a end portion 26 which supports an axial shaft 27 on which the divider pivots. The axial shaft 27 extends through a hole 46 in the stator 10 and passes out the end of the stator. As can be seen more clearly in FIG. 11, a spiral spring 28 locates in a slot in the end of each axial shaft 27 and is fixed to the stator 10 in order to bias pivotal movement of the respective moveable divider in a manner whereby an edge of the divider bears on the shaft driver 13. A further roller bearing 29 is located in the stator to support the output shaft 12. As is apparent in the drawings, holes 30 in the stator 10 and corresponding holes 31 in the end plate 11 enable the two parts to be bolted together in sealing engagement by bolts (not shown).

Figure 10:
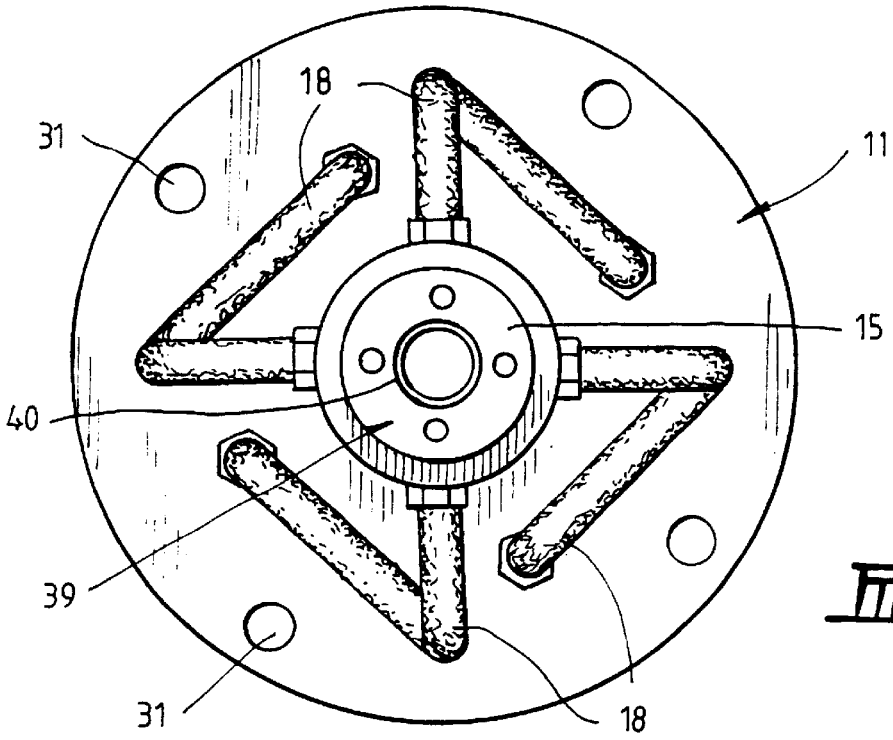
FIG. 10 is similar to FIG. 4 with end cap removed.
Figure 11:
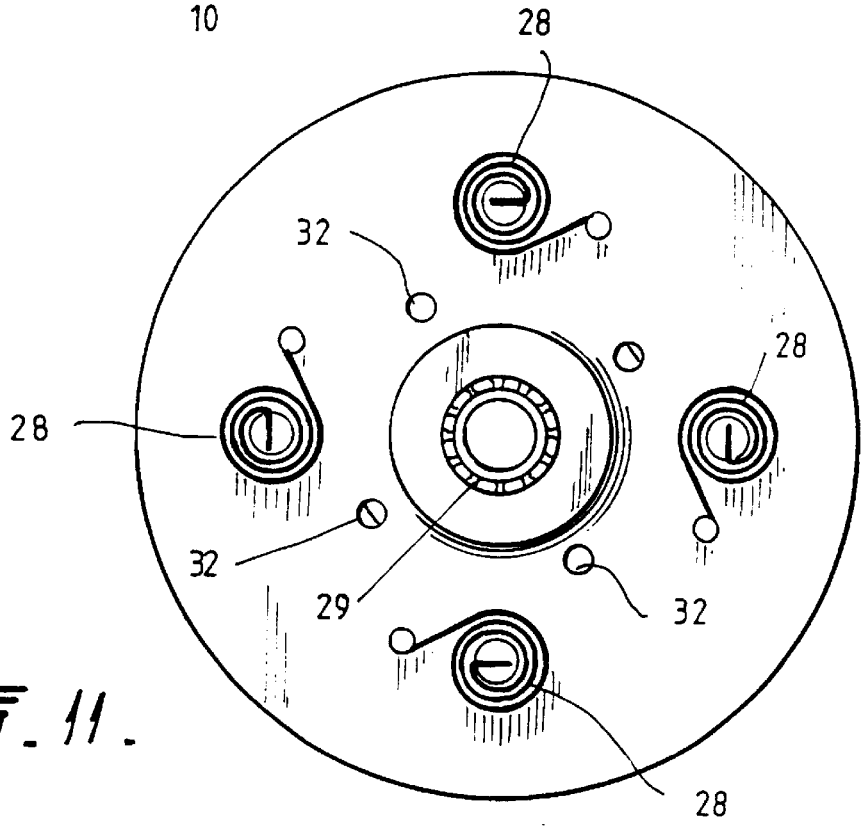
FIG. 11 is an end view of the engine from the output end with output shaft removed.
Figure 12:
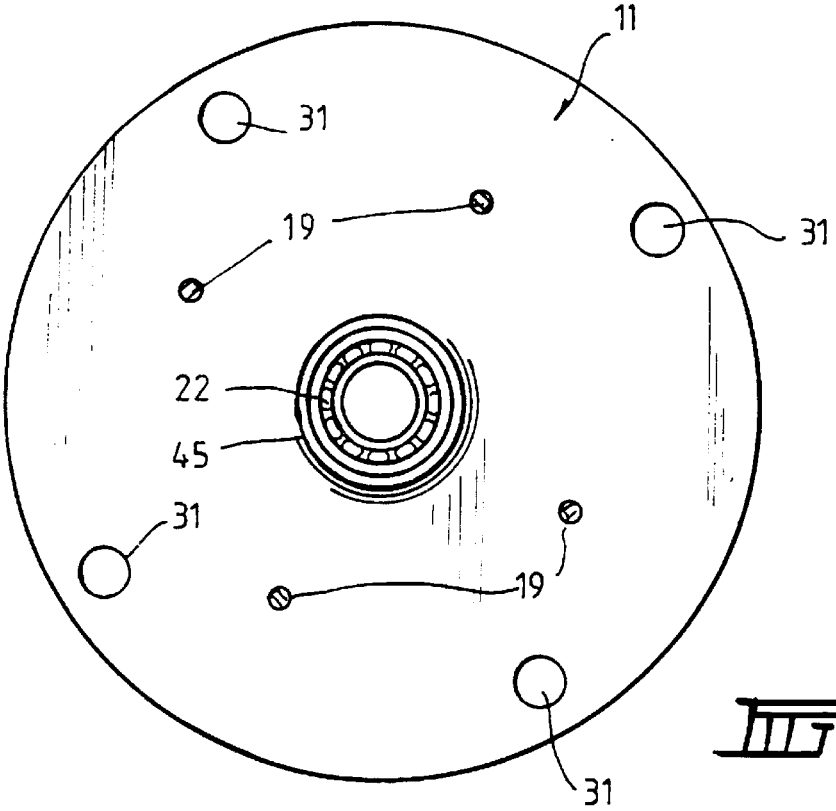
FIG. 12 is an end view of the engine end plate with inlet manifold and end cap removed.
Figure 13:
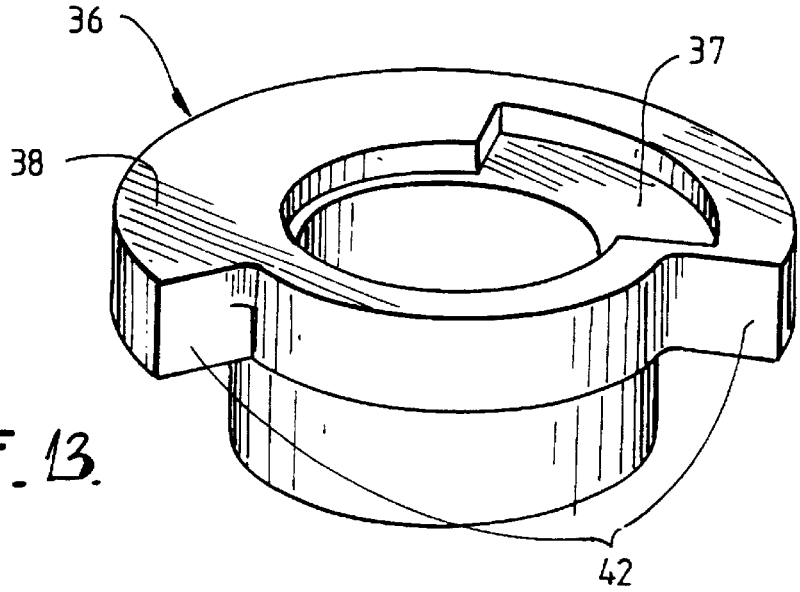
FIG. 13 is an enlarged perspective view of a timing member located at the inner end of the output shaft.

As is evident in FIGS. 5 and 11, exhaust ports 32 extend from the cylindrical stator cavity 14 through the fixed end of the stator 10 to allow exhaust air to dissipate to atmosphere. In addition to these exhaust ports 32, which allow primary exhaust air to dissipate at the opposite end of the stator 10 to the inlet manifold 15, a further or secondary exhaust route is provided via the inlet ports 19 and the inlet manifold 15. The secondary exhaust route follows the inlet air path back to the start of the ports 20 and a timing member or disc member 36. (FIG. 13) which bears on the outer surface 39 (FIG. 10) of the inlet manifold 15. A recessed portion 37 of the timing or disc member 36 allows one of the ports 20 to communicate with the bore of the timing disc 36. The bore of the timing or disc member 36 is a clearance fit over output shaft 12 (creating space 40) and thus any exhaust air forced back via the inlet manifold to timing or disc member 36 is captured within the recessed portion 37 and forced into space 40. As radial hole 47 in the inlet manifold extend to the space 40 and provides an exhaust outlet for this secondary exhaust air.

The output shaft 12 consists essentially of a straight shaft that is mounted in the roller bearings 22 and 29 of the inlet end plate 11 and stator 10, respectively. A driven plate 33 is mounted on the shaft and in the assembled engine locates within the shaft driver 13. The driven plate 33 has mounted thereon a pair of roller bearings 34 which are closely adjacent to each other and to one side of the shaft. The roller bearings 34 bear on the inside wall of the shaft driver 13 and are driven around the inner perimeter of the shaft driver 13 as will become apparent hereinbelow. The driven plate 33 is arranged to be rotationally balanced with the roller bearings 34. At the inner end of the shaft 12 a nut 35 retains the timing disc 36 on the shaft. The timing or disc member 36 has recessed portion 37 in a surface 38 of the timing or disc member 36 which bears on the outer surface 39 of the inlet manifold 15. As is evident in FIG. 10, the manifold 15 fits over the output shaft 12 and a space 40 exists therebetween. The recessed portion 37 as it moves around on the outer surface 39 exposes the ports 20 to the space between the inlet manifold and the shaft. The previously described radial hole 47 in the inlet manifold communicates with the space 40 and enables further exhausting of air in an expansion chamber of the engine as will become apparent hereinbelow.

A cut-out portion 42 in the circumference of the timing or disc member 36 exposes the ports 20 to inlet air pressure from the air intake 17. The timing or disc member 36 is therefore responsible for timing functions related to inlet air pressure and secondary exhaust air from the expansion chambers.

Figure 14:
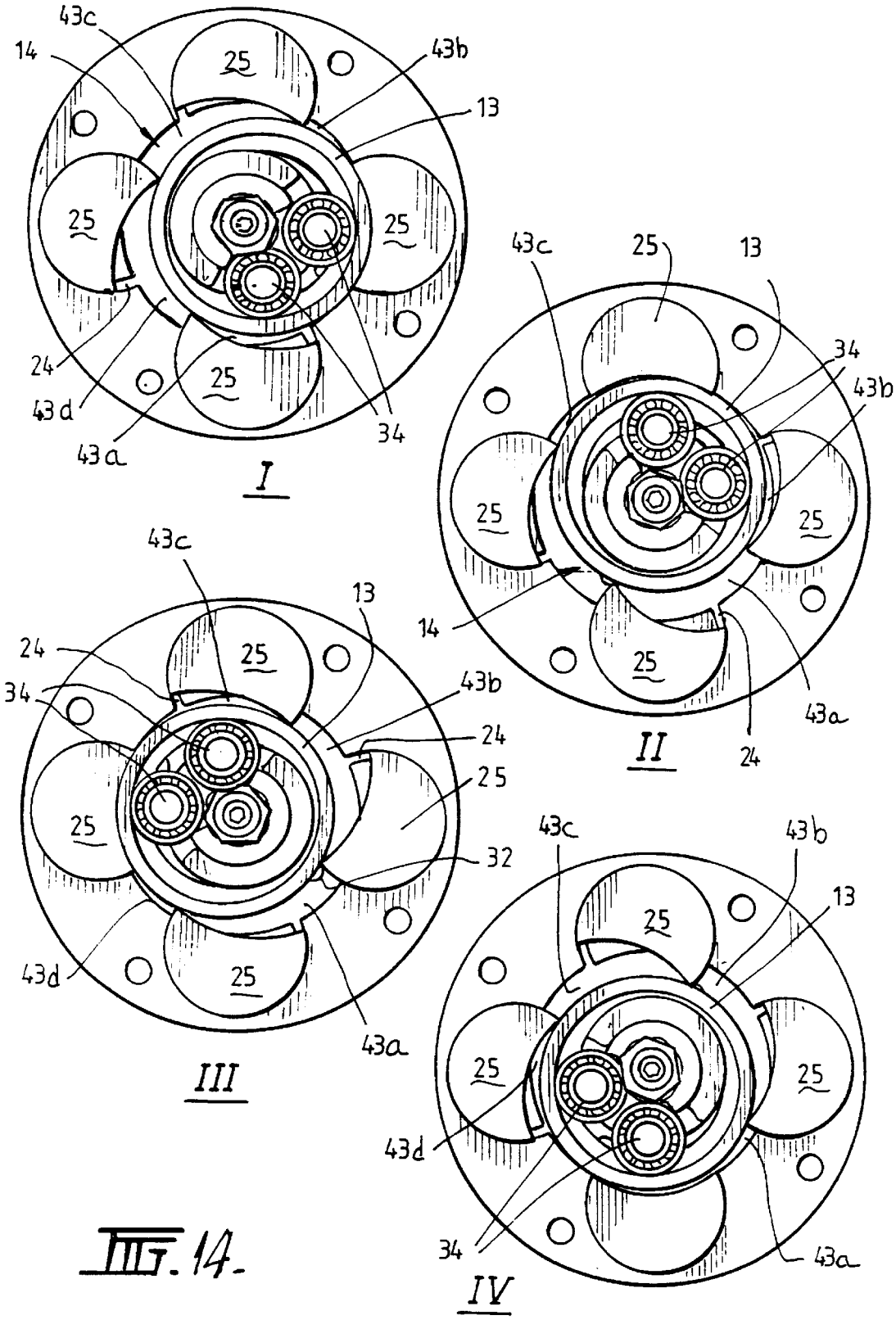
FIGS. 14(i)–(iv) show a cycle of the shaft driver within the stator cavity to produce a single revolution of the output shaft.

As will be evident in FIG. 5 and FIG. 14, expansion chambers 43 of the engine are formed between the outer surface of the shaft driver 13, the surface of the stator cavity 14 and between the dividers 25 where they contact the surface of the shaft driver 13. These expansion chambers 43 take varying shapes as the shaft driver 13 moves within the stator cavity 14. In order to better understand this movement, reference should now be made to FIG. 14 which shows a cycle of the engine resulting in a complete revolution of the output shaft 12. The engine is driven in this embodiment by compressed air and air under pressure is therefore connected to air intake 17 on the end cap 16. A suitable valve (not shown) is provided in order to open the supply of compressed air.

In FIG. 14, the four expansion chambers are labelled (a), (b), (c) and (d) for convenience in explaining a cycle of operation. Referring to FIG. 14(i), the expansion chamber 43(*a*) is receiving pressurised air because the timing member 36 is positioned on the end of the inlet manifold so as to expose the relevant port 20 to the pressurised air. Pressure in expansion chamber 43(*a*) creates a force against the side of the shaft driver 13 causing it to move in a direction whereby its contact with the surface of stator cavity 14 moves in an anti-clockwise direction. In other words, the shaft driver 13 does not specifically rotate but moves in a type of motion whereby the point or surface contact between it and the stator cavity 14 moves around the circumference of the stator cavity 14. Further expansion of the chamber 43(*a*) causes the shaft driver 13 to assume a position as shown in FIG. 14(ii) and at this point in time, the shaft has rotated through 90° as shown by the position of the roller bearings 34 which are forced to remain in a space available internally in the shaft driver 13 by virtue of its offset position relative to the axes of the output shaft 12. This rotation of the output shaft 12 through 90° causes the timing member 36 to expose the next relevant port 20 to high pressure air which then enters the expansion chamber 43(*b*) further pushing the shaft driver 13 around within the stator cavity 14.

It should be mentioned at this time that whilst the movable dividers are spring biased so that an edge thereof remains in contact with the outer surface of the shaft driver 13, pressure in an expansion chamber also acts via arcuate grooves 24 on the edge of the divider 25 not in contact with the shaft driver 13, to thereby assist in applying pressure between the divider and shaft driver.

Referring now to FIG. 14(iii), it can be seen that the cycle continues and in the position shown in FIG. 14(iii), the shaft has rotated 180°. In this position, compressed air is being received in expansion chamber 43(*c*) whilst chambers 43(*a*) and 43(*b*) have been fully expanded. It should be noted that movement of the shaft driver 13 has exposed exhaust port 32 in chamber 43(*a*) whereby subsequent contraction of the chamber 43(*a*) by further movement of the shaft driver allows some of the air in chamber 43(*a*) to exhaust via the exhaust port 32.

As shown in FIG. 14(iv), the shaft driver 13 has moved to a new position whereby the output shaft 12 has rotated through 270° from the initial position. In this position, the exhaust port 32 shown in FIG. 14(iii) has been closed by the movement of the shaft driver 13 but the chamber 43(*a*) is still contracting. This contraction of chamber 43(*a*) would compress air in that chamber if there was no other means for the air to escape. Such means is provided by the previously described secondary exhaust route. This enables air to return via the appropriate inlet port 20, into the recessed portion 37 of the timing member 36 and then into the space 40 between the inlet manifold and output shaft to eventually exit via exhaust port or radial hole 47. This means that the expansion chamber 43(*a*) can continue to contract in size as is evident in FIGS. 14(iii) and 14(iv) without compressing air in that chamber and resisting such movement. Similar events occur as the other chambers contract. In the next step of the cycle the components resume the position shown in FIG. 14(i).

As will be evident from the above description, the shaft driver 13 moves in the stator cavity 14 whereby contact between the outer circumference of the shaft driver 13 and the surface of stator cavity 14 moves around the cavity 14 as each expansion chamber receives compressed air. This movement may be considered as a type of orbital movement and whilst the shaft driver 13 does not rotate at the same speed as the output shaft 12, there is some rotation of the shaft driver 13. The speed of rotation of the shaft driver 13 depends upon the difference in circumference between the shaft driver and the stator cavity 14. Generally speaking, the shaft driver 13 rotates at a speed of about $1/12^{th}$ to $1/20^{th}$ of the speed of rotation of the output shaft 12. This provides a distinct advantage in that there is minimal wear between the surface of the movable dividers 25 where they contact the shaft driver 13 and the surface of the shaft driver 13. This is because there is little rotation of the shaft driver 13 relative to the output shaft 12. As will also be evident, rotation of the output shaft 12 is caused by the roller bearings 34 moving, or remaining, in the space provided for them within the shaft driver 13.

The direction of rotation of the output shaft 12 is simply reversed by rotating the manifold 15 on the cylindrical boss

45. The rotation of the manifold will expose next port 20 to the cut-out portion 42 in the circumference of the timing member 36 to communicate the interior of the end cap 16 with chamber 43(*b*) instead of chamber 43(*a*) as per FIG. 14(i).

Whilst the embodiment described above relates to an engine driven by compressed air, clearly other types of engines may be readily constructed. For example, by providing spark plugs in the stator cavity 14 for each expansion chamber and introducing a fuel/air mixture into the engine, an internal combustion engine may be provided. Also, the engine could be driven by steam or by other fluid means. It is also conceivable that an internal combustion engine embodiment of the invention could drive a vehicle as well as an air compressor in the vehicle whereby during certain times, the fuel air mixture could be turned off and the engine could run from compressed air provided by the compressor. This would have advantages where fuel is not available or where pollution by internal combustion engine exhaust is a sensitive issue. For example, within certain city limits internal combustion engines may be prevented from use in the future and an engine of the type described herein could be run on compressed air for periods of time whilst in these areas.

It should be apparent that the engine according to the present invention offers many advantages over existing engines. For example, the engine is non-reciprocating and therefore is essentially vibration free. There are fewer moving parts and minimum friction resulting in a much more efficient engine with minimum wear. The output shaft of the engine is a straight shaft and therefore avoids many of the inherent balancing and vibration problems of existing reciprocating engines. In order to increase the output power of the engine according to this invention, it is merely necessary to provide additional stator assemblies on the same output shaft. The engine is compact and lighter than existing engines and this results in improved efficiency.

Whilst one particular embodiment has been described in detail, it should be evident to persons skilled in the art that variations may be readily effected without departing from the spirit and scope of the invention. Clearly additional parts can be added to provide a production version of the engine. For example, it would be necessary to provide an outlet manifold covering the exhaust ports 32 in order to direct the exhaust air to a single exhaust outlet point. Also, a fly-wheel (not shown) would be provided in order to contribute to the smoother running of the engine.

What is claimed is:

1. An engine comprising a shaft driver located in a stator cavity of the engine and surrounded by expansion chambers defined between a wall of the shaft driver and the wall of the stator cavity, characterized in that, said shaft driver is a hollow cylinder, and said expansion chambers are separated by movable dividers mounted in said stator and bearing on said shaft driver, an output shaft is rotatably supported in said stator passes centrally through said stator cavity and through said shaft driver and said output shaft has bearing means to one side of said output shaft which bear on the inside surface of said shaft driver, said shaft driver bearing on said stator wall at a circumferential point extending along the length of the cylindrical wall of the shaft driver and said circumferential point moves around the wall of said stator during said orbital and rotational movement, whereby one revolution of said circumferential point around said stator wall is equivalent to one revolution of said output shaft, and during said one revolution of said shaft driver rotates about its own axis only a small fraction of a revolution, and whereby a combination of orbital and rotational movement of said shaft driver causes rotation of said output shaft at a rotational speed much greater than the rotational speed of said shaft driver.

2. The engine as defined in claim 1, characterized in that, said small fraction of a revolution is about $1/10^{th}$ of a revolution or less.

3. The engine as defined in claim 1 characterized in that, said small fraction of revolution is between $1/10^{th}$ and $1/20^{th}$ of a revolution.

4. The engine as defined in claims 2 and 3, characterized in that, said movable dividers comprise part cylindrical dividers which pivot on a central axial shaft of the divider, the part cylindrical wall of each divider being located in an arcuate groove in the stator whereby pivotal movement of a divider causes an edge of said cylindrical wall to bear on said shaft driver to thereby define one extremity of said expansion chamber.

5. The engine as defined in claim 4, characterized in that the wall of said stator cavity is cylindrical and extends between an end wall of said stator at one end, and a removable inlet end plate at the other end, and said arcuate grooves and said dividers extend the length of said stator cavity.

6. The engine as defined in claim 5, characterized in that, said bearing means comprise a pair of roller bearings mounted on a disc locked to said shaft.

7. The engine as defined in claim 6, characterized in that said removable end plate has inlet ports to the respective expansion chambers and said end wall of said stator has outlet or exhaust ports.

8. The engine as defined in claim 7, characterized in that, said movable dividers are spring biased to pivot such that said edge remains in contact with said shaft driver.

9. The engine as defined in claim 8, characterized in that, an inlet manifold is mounted to said removable end plate for directing inlet air to said inlet ports.

10. The engine as defined in claim 9, characterized in that, said inlet manifold also provides for egress of some exhaust air flow.

11. The engine as defined in claim 10, characterized in that, a timing member is mounted onto an inner end of said output shaft to rotate with said output shaft, said timing member selectively covering said inlet ports during rotation to control inlet airflow to said engine.

* * * * *